United States Patent [19]

Chalabian

[11] 4,062,435

[45] Dec. 13, 1977

[54] WATER PROOF COIN MECHANISM

[75] Inventor: Jack S. Chalabian, Gardena, Calif.

[73] Assignee: K-Jack Engineering Company, Inc., Gardena, Calif.

[21] Appl. No.: 663,354

[22] Filed: Mar. 3, 1976

[51] Int. Cl.[2] ..... G07F 1/04

[52] U.S. Cl. ..... 194/54; 194/1 K

[58] Field of Search ..... 194/1 R, 1 A, 1 K, 59, 194/1 G, 54

[56] References Cited

U.S. PATENT DOCUMENTS

| | | | |
|---|---|---|---|
| 862,655 | 8/1907 | Price | 194/1 K |
| 912,389 | 2/1909 | Long | 194/1 K |
| 2,108,651 | 2/1938 | Cherry et al. | 194/1 K |
| 3,791,503 | 2/1974 | Haeusser | 194/1 G |
| 3,884,330 | 5/1975 | Chalabian | 194/59 |
| 3,941,227 | 3/1976 | Gordon | 194/1 K |

*Primary Examiner*—Stanley H. Tollberg

*Attorney, Agent, or Firm*—George F. Smyth

[57] ABSTRACT

A coin sorting and access control mechanism for a vending machine comprising a central wall member having chute-forming members pivotally mounted on either side thereof and biased toward the central wall. Each chute is provided, at the upper portion thereof, with a funnel located so as to receive coins inserted through a slotted coin plate by a consumer wishing to gain access to the product being vended. The coin mechanism includes a funnel having multiple-apertured coin contacting surfaces which lead to coin transfer chutes. The coin transfer chutes, and the central wall therebetween, are provided with elongated slots extending therealong. The chute walls are also provided with surfaces which minimize coin surface area contact. Thus, the funnels, slots, and coin contacting surfaces minimize any surface tension which might arise in moisture between the mechanism and coins inserted into the machine.

9 Claims, 6 Drawing Figures

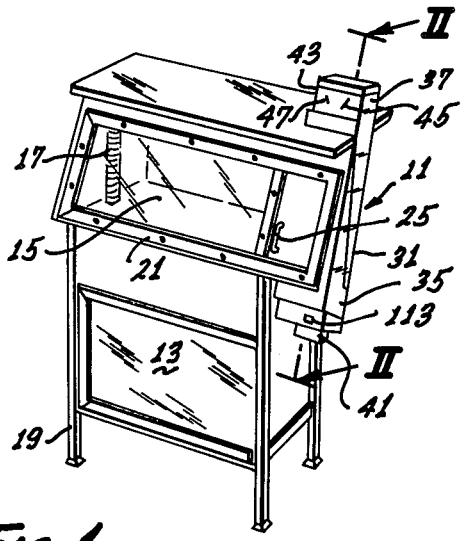
FIG. 1
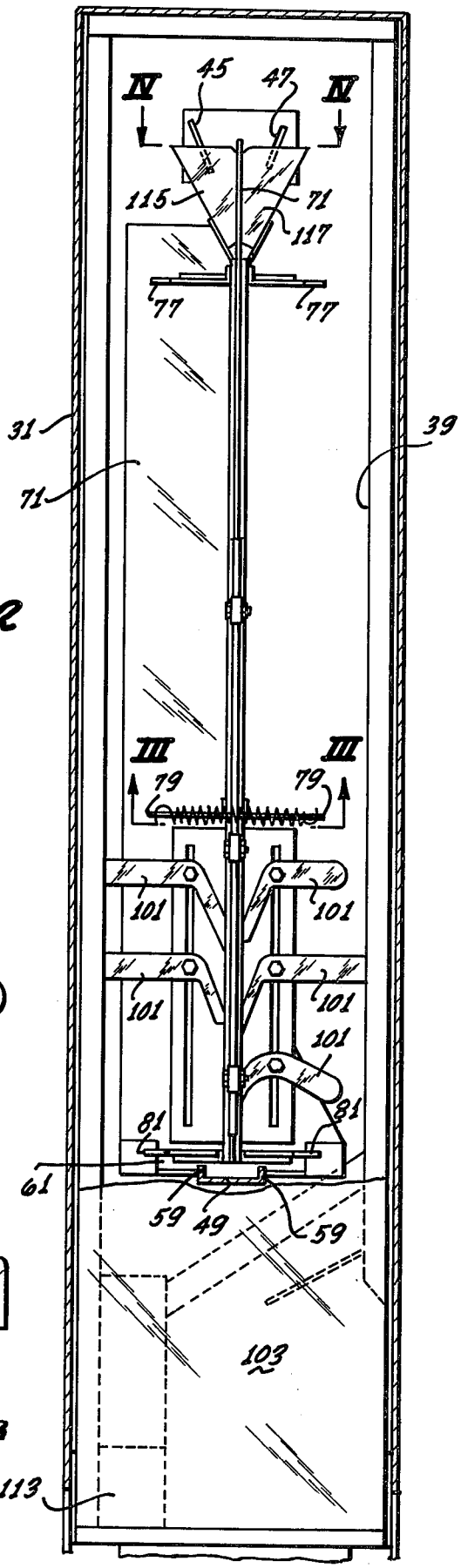
FIG. 2
FIG. 3
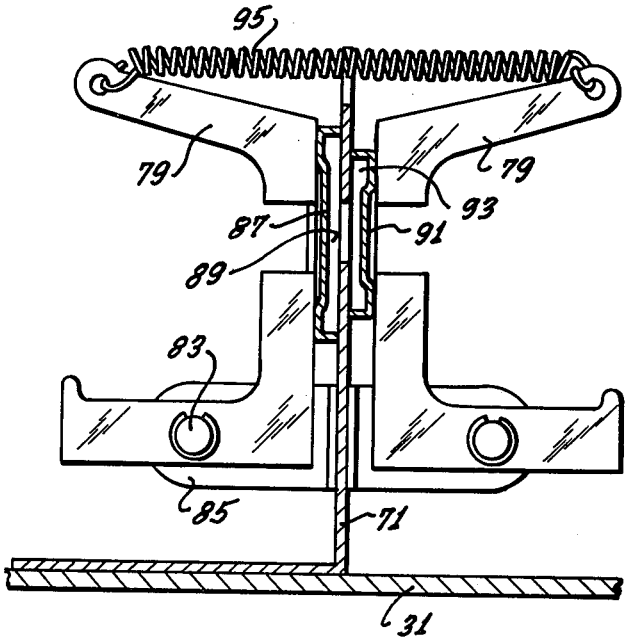

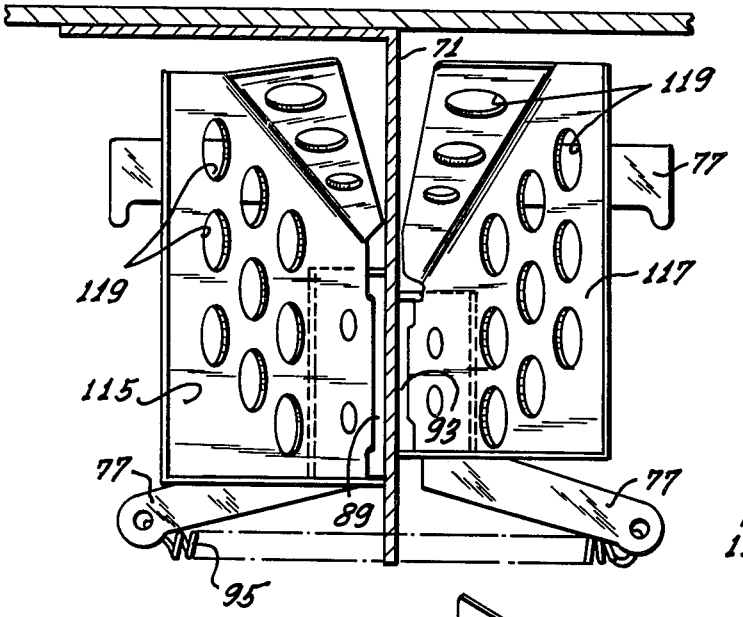
FIG. 4
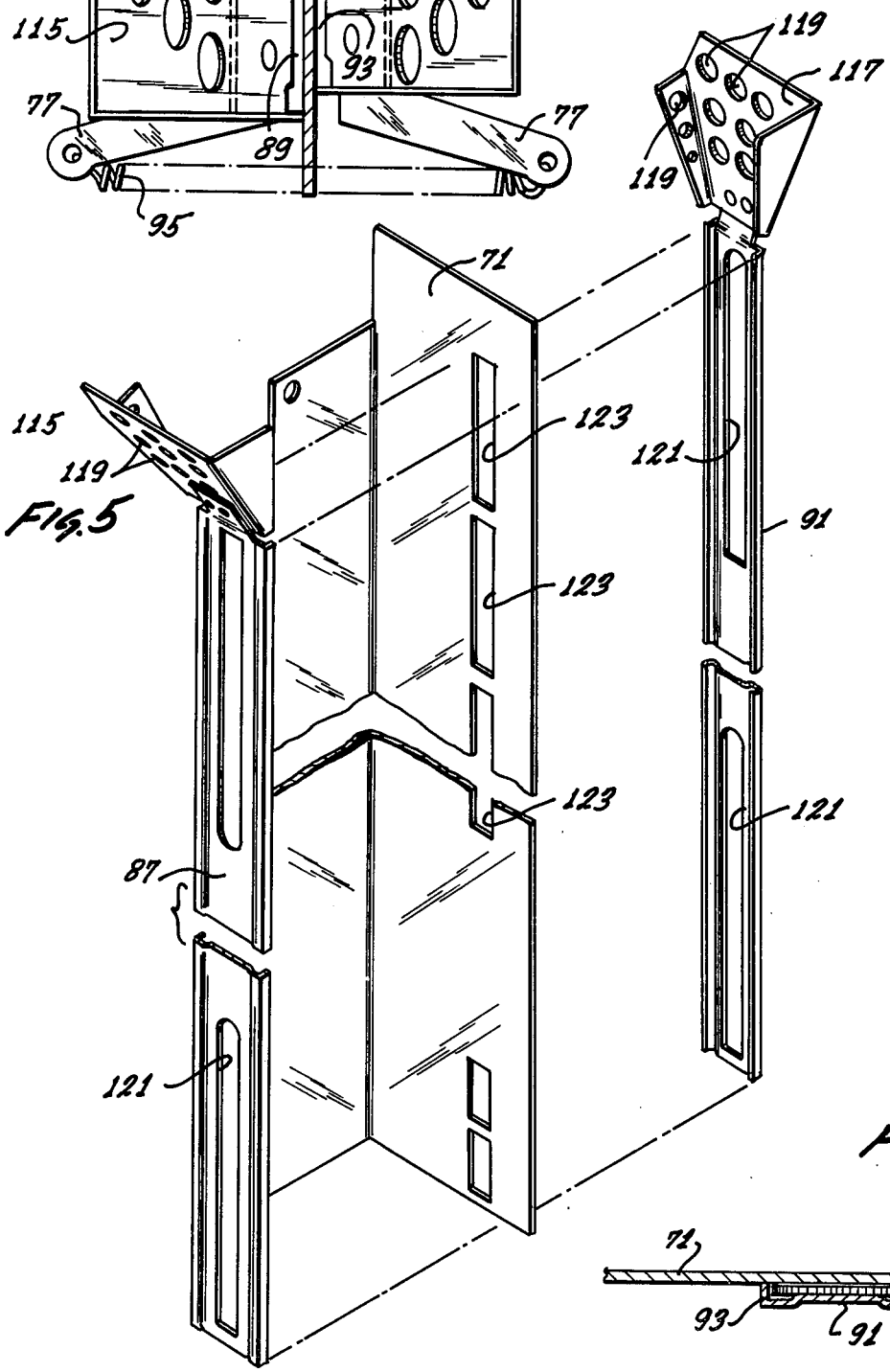
FIG. 5
FIG. 6
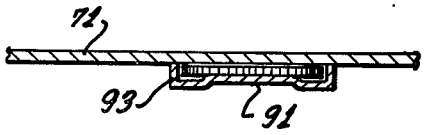

WATER PROOF COIN MECHANISM

BACKGROUND OF THE INVENTION

In U.S. Pat. No. 3,884,330, assigned to the assignee hereof, there has been disclosed a coin operated vending machine having a door-operated mechanism for returning rejected coins. Such machines have commonly been employed to vend newspapers on street corners, etc. In many instances, machines are so located that they are subject to the elements to such an extend that the operation of the machine might be affected. For example, as shown in the above-cited patent, it is preferred that the coin mechanism be mounted on an angle relative to a vertical plane so that, if the wrong value of coins or some other foreign matter is inserted into the machine through a coin slot, the chutes will be opened when a consumer attempts to open the product access door of the machine. As the chutes are opened, the coins and other matter is rejected and returned to the consumer through a coin return opening. In other words, an inclination of the coin sorting and control mechanism is desired so that the rejected material travels a predetermined path toward the coin return, rather than into a coin storage device within the housing.

Since the mechanism and its housing are mounted on an incline, it is possible for rain water or other moisture to enter into the mechanism housing through the coin slot. Also, it is possible that, during rainy weather, consumers will insert coins which are wet through the slot in order to obtain a newspaper or other product being vended. Such moisture in the mechanism has been found to act between the mechanism and the coin to generate a fluid surface tension which can foul the mechanism by allowing the coins to "stick" in place in various locations in the mechanism. Consequently, the machine will not open when the consumer pulls on the door handle and his coins are not returned to him through the coin return system.

When this occurs, it has been found that the normal human reaction is one of frustration which is often released by an angry attack on the object of his frustration—the machine. Such an attack may severely damage or destroy the machine.

Consequently, it has been found desirable to provide a machine in which all coins either actuate the machine or are rejected, regardless of the existence of moisture in the mechanism. In other words, any moisture in the machine should be prevented from generating sufficient surface tension as to inhibit movement of the coins in the mechanism.

SUMMARY OF THE INVENTION

The present invention relates to a coin sorting and control mechanism which may be utilized in a machine to prohibit operation thereof until the consumer has inserted predetermined coinage into the mechanism. Further, the invention relates to a mechanically operated mechanism which is actuated by coins of predetermined diameters, such as nickels, dimes, and quarters, so that, when the proper coins have been inserted into the machine, it will release a latching mechanism to allow the consumer to operate the machine. For example, he can remove the product being vended from the display or storage portion of the machine.

More specifically, the present invention relates to such a mechanism in which the surface contact area between the mechanism and a coin inserted thereinto is minimized to reduce the maximum surface tension which might be generated by moisture in the mechanism. In fact, the contact surface area is so sufficiently reduced that only a small amount of surface tension can be generated and that amount will be insufficient to prevent movement of the coin in the desired path. Further, the mechanism surface tension reducing structure also will serve to strip moisture away from the coins and allow such moisture to fall away from the mechanism.

In general, a coin sorting and control mechanism which may employ the present invention may, if desired, be somewhat similar to that shown in U.S. Pat. No. 3,884,330, modified only insofar as it is necessary to employ the invention hereof. For example, that prior patent shows a coin transfer mechanism which provides a pair of funnels to receive coins inserted through slots in a face plate of a vending machine.The funnels deliver the coins into a pair of transfer chutes which extend along a central body or plate until the coins are stopped on a coin seat formed on a door latch which extends into a cooperative relationship with the mechanism. When the consumer pulls upon the door handle, if the proper coinage has been inserted into the machine, the coins will act between certain pawls in the mechanism to bias the latch out of the latched position and allow the door to be opened. On the other hand, if the wrong value of coins has been inserted into the mechanism, or some foreign material exists therein, the latch will pull against an actuating lever, opening the chutes and allowing the rejected material to fall into a coin return slot.

In any event, whether that structure or some other structure is employed, the present invention relates to the concept of minimizing the surface area of the mechanism which may be in contact with a coin at any given time and which, preferably, will allow moisture to be stripped away from the coin. For example, the coin-receiving funnels within the housing may be provided with a large number of apertures so that only a small surface area of the funnels can be in contact with a coin at any given time. Further, as the coins pass over the surface area of the funnels, water will tend to be stripped from them through the apertures so that it will fall away harmlessly.

In the chutes themselves, longitudinal slots can be formed in the side and central walls to again reduce the surface area. Further, either or both chutes may be provided with a slightly raised central portion of the inner wall, thereby prohibiting a coin from entering into full surface contact across the face of the coin at any point along the length of the wall.

Those skilled in the art, upon review of the following detailed description and the accompanying drawings, will quickly become aware of the many advantages of this invention and additional embodiments thereof will soon come to mind.

BRIEF DESCRIPTION OF THE DRAWINGS

FIG. 1 comprises an isometric illustration of a newspaper display and vending machine utilizing the present invention;

FIG. 2 comprises a rear elevation of a mechanism formed in accordance with the present invention, mounted in a housing such as might be employed with a newspaper vending machine;

FIG. 3 comprises a sectional view of the mechanism illustrated in FIG. 2, as seen along the line III—III thereof, FIG. 4 comprises a top plan view of the mechanism illustrated in FIG. 2, as seen along the line IV—IV thereof;

FIG. 5 comprises an exploded view of the main portions of the mechanism illustrated in FIG. 2; and FIG. 6 comprises an enlarged illustration of a portion of one of the coin chutes, depicting a coin traveling therethrough.

DETAILED DESCRIPTION

A newspaper display and vending machine 11 has been illustrated in FIG. 1 as comprising a housing 13 in which a platform 15 has been mounted and supported by coiled springs 17 for vertical movement within the housing. Newspapers may be supported on the platform 15 and the entire structure supported on the ground by means of a plurality of legs 19. It should be realized that such a machine is here illustrated only for the sake of illustration and that any type of vending machine or other structure, to which access is to be limited until proper payment is made, might be employed with the present invention.

In any event, with reference to FIG. 1, the front panel 21 of the display and storage compartment of the machine may be pivotally attached to the housing 13 by one or more hinges 23 so that, when the handle 25 is pulled, the entire panel or door 21 tends to move about the pivot of the hinge 23 and access may be gained to the product located within the machine.

To one side of the machine, a housing or body 31 may be suitably attached by any suitable means such as welding, bolts, a panel such as at 35, etc. A suitable cover 37, such as that disclosed in co-pending application Ser. No. 664,546 filed Mar. 8, 1976 may fit over the top of the housing and extend part way down the front of the body. The cover may cover the sides of the body and enclose an open back portion 39 of the body (FIG. 2). The cover and the bottom of the body 31 may be provided with cooperable padlock-receiving means 41 so that a padlock passed therethrough may be used to lock the cover to the body.

Immediately below the lower extremity of the front portion of the housing cover 37, a face plate 43 may be provided having one or more coin slots 45 and 47. If desired, these slots may be proportioned to accept coins only of predetermined sizes. For example, slot 45 may be so proportioned as to accept only dimes, whereas slot 47 will accept quarters and nickels.

As disclosed in said prior U.S. Pat. No. 3,884,330 and as partially illustrated in FIG. 2, a channel-like locking bar or latch 49 may be mounted on the innersurface of the door 21 and biased upperwardly by a suitable spring device. On each side of the channel 49, a finger or tooth 59 may be provided to extend above the plane of the latch so that when the door is pulled, and incorrect or insufficient coins are in the mechanism, the teeth 59 will contact an actuating lever 61 and the consumer will be prevented from opening the door. Further, when the door is pulled, the actuating lever will open the chutes so that any material therein will spill out and be returned to the consumer via a coin return opening 113 in the front of the housing.

On the other hand, a coin set or camming surface may be formed on the end of the locking lever 49 distal from the door 21 so that, when proper coins are in the mechanism, the lever will be forced downwardly, as viewed in FIG. 2, about its pivot on the door and against the force of its biasing spring so that the fingers 59 are moved below the plane of the actuator lever 61, thereby allowing the door to be opened.

In general, the above-described structure does not comprise the specific subject matter of the present invention, but is merely meant to illustrate one embodiment of structure in which the present invention may be utilized to restrict access to a compartment in which a product is stored for self-service sale.

In order to transfer the coins from the slots 45 and 47 to positions in which they rest upon the upper surface of the latch 49, a mechanism may be provided similar to that taught in U.S. Pat. No. 3,884,330 but formed in accordance with the present invention, on embodiment of which will now be described.

Referring now to FIGS. 2–5 more specifically, a main, fixed wall member 71 may be formed to have a substantially L-shaped configuration, as seen in FIGS. 3 and 5, and may be fixed to the interior surface of the front wall of the housing or body 31 by any suitable means such as welding, bolts, etc.

A plurality of brackets 77, 79, and 81 on each side of the wall 71 may be suitably mounted to pivot about fixed points on their respective sides of the wall. Thus, as seen in FIG. 3, the bracket 79 on the left side of the wall 71 is pivoted about a point 83 located in a fixed bracket 85 which is fastened to the central wall 71. Brackets 77, 79, and 81 are each fixed to a movable wall 87 or 91, which is located on their respective side of the central wall. Wall 87, together with the central wall 71 forms a first coin chute 89. Thus, when one of the brackets 79 is pivoted about its pivot point 83, the wall 87 will be pulled away from the central wall 71 and any coins or other material therein will be released or returned to the consumer. Similarly, on the opposite side of the central wall 71, a second movable wall 91 may be fastened to the opposite bracket 79 to form a chute 93 with the central wall 71.

As disclosed in U.S. Pat. No. 3,884,330 when the teeth 59 on the locking lever 49 are pulled against the actuating lever 61, the brackets 77, 79 and 81 will move about their pivots so that the chutes 89 and 93 are opened. Since, as shown in FIG. 1, the entire housing is inclined relative to a vertical plane, the coins will fall to the back of the housing for delivery to the return slot 13. Also, if desired, two, or more brackets on opposite sides of the central wall 71 may be joined by a spring 95 which will draw the movable chute walls 87 and 91 back into their cooperative relationship with central wall 71 when the door is released.

When the coins reach the bottom ends of the chutes 89 and 93, they will rest upon a coin seat on the locking bar 49 and be forced upwardly against various pawls 101, which may be selected by the vendor depending upon the price to be charged for the vending item. Since only limited coin movement can occur in this manner, the coins will force the locking bar 49 downwardly to allow the door to be opened. Then, the coins fall into a coin storage area 103 for later retrieval by the vendor.

When the coins are pushed through one of the slots 45 and 47, they will fall into a related funnel 115 or 117 formed by an angularly related metal or other rigid element which may be fastened to the respective movable walls 87 and 91 as illustrated in FIG. 5. Thus, as will be realized, when the walls 87 and 91 are pulled away from the central wall 71, the funnels 115 and 117 will travel with them until the consumer releases the door and the elements are returned to their original positions under the influence of spring 95.

In the past, when a consumer inserted a coin through one of the slots 45 or 47, any water which might have gotten into the mechanism either through the slots or on the coins being inserted, could cause the coins to "stick" to the sides of the funnels and/or the chutes 89 and 93. Obviously, when this occurred, the coin could not fall to the channel 49 so that the door of the machine could be opened, even though the correct value of coins had been inserted. Even more seriously, the coins would not fall to the return slot so that the consumer could at least regain the money he had inserted.

In the present invention, this problem has been overcome, in part, by providing a plurality of apertures 119 in one or more of the walls of the funnels 115 and 117, as illustrated in FIGS. 4 and 5. Thus, if moisture should get into the housing it will not travel down the funnel walls and into the chutes but will fall through one or more of the apertures 119 and then to the bottom of the housing where it will do no damage. On the other hand, if a wet coin is inserted into the mechanism, the area of contact between the coin and the chute will be significantly reduced by the aperture 119 to such an extent that any surface tension which might build up in the moisture between the funnel wall and the coin will be so low that it cannot overcome the force of gravity acting on the coin to draw it toward the related chute. Also, as the coins cross the apertures in the funnel walls, water will tend to be stripped from the coins as they pass over the aperture edges, thus allowing the water to fall away from the machanism.

As illustrated particularly in FIG. 5, the movable walls 87 and 91 of the respective chutes may also be provided with longitudinal slots 121 which, again, reduces the surface area available for contact between a coin, falling through the chutes, and the movable wall. Similarly, a plurality of longitudinal slots 123 may be formed in the central wall 71 for substantially the same purpose.

A third method of reducing the potential surface area of contact between coins and the walls of the chute has been shown in FIGS. 3 and 6. There, the movable walls 87 and 91 are provided with raised central portions and depressed edge portions, within the chutes 89 and 93, so that only the central portion of the movable chute walls can come into contact with coins. Of course, it will be realized by those skilled in the art that the chutes can be formed in this manner with any desired amount of depression of the edges of the chute walls, although the depiction of the figures may be considered to be exaggerated, somewhat, for the purpose of illustration.

However, as illustrated in FIG. 6, when a dime 131 falls through a chute 93, only the central portion of the wall 91 can enter into contact with the face of the dime and, if a longitudinal slot such as 121 is formed in the movable wall, even that surface area will be further reduced. Also, any moisture on the dime, after it has passed through the related funnel, will tend to be stripped away from the surface of the dime as it traverses the ends of the longitudinal slots 121.

Consequently, coin operating mechanisms employing the present invention will no longer be susceptible to sticking or jamming during inclement weather since the coins will be able to traverse the mechanism with only a minimum of surface area contact and the coin cannot become even momentarily stuck to a portion of the mechanism. Similarly, if incorrect coinage or foreign matter should be inserted through the slots 45 or 47, the reduced surface area of contact between the mechanism and the coinage and material will allow immediate and easy rejection through the return slot 113.

Having now studied this disclosure, those skilled in the art will quickly realize that the present invention may be employed in a wide variety of embodiments, many of which may not even resemble that depicted here but which, nevertheless, enjoy many or all of the advantages now available as a result of this invention as now claimed.

I claim:

1. In a coin actuated outdoor apparatus having a coin chute therein, the improvement for reducing surface tension between the walls of said chute and a wet coin inserted therein while stripping moisture from the wet coin during its passage through said chute, said improvement comprising:

said chute having opposed generally parallel surfaces;

said surfaces being spaced apart a distance which slightly exceeds the thickness of a coin to be inserted into said chute such that at least one of said generally parallel surfaces contacts at least one surface of the inserted coin, means formed on said generally parallel surfaces to reduce the surface tension between said surfaces and a coin inserted in said chute, said means to reduce surface tension including raised portions on at least one of said generally parallel surfaces such that contact between said surfaces and a coin within said chute being thereby reduced by the presence of said raised portions, whereby the presence of water on said apparatus or on coins inserted in said chute during inclement weather has a reduced tendency to cause sticking of coin within said chute, said chute being formed by a central wall and adjacent spaced wall members, a plurality of pawls mounted on the lower end of said chute and cooperating with coins in said chute to effect actuation of said apparatus when proper coinage is deposited in said chute, funnel means cooperating with said coin chute and receiving coins to be fed into said chute, and said funnel means including means to permit water contacting said funnel to pass therethrough and to reduce surface tension tending to cause a coin to stick in said funnel when one or both of said coin or said chute are wet.

2. The apparatus of claim 1 wherein said chute and said parallel surface are inclined with respect to the vertical, whereby moisture stripped from a coin inserted into said chute may fall downwardly in a generally lateral direction away from said chute.

3. In a coin actuated outdoor apparatus having a coin chute therein, the improvement for reducing surface tension between the walls of said chute and a wet coin inserted therein while stripping moisture from the wet coin during its passage through said chute, said improvement comprising:

said chute having opposed generally parallel surfaces;

said surfaces being spaced apart a distance which slightly exceeds the thickness of a coin to be inserted into said chute such that at least one of said generally parallel surfaces contacts at least one surface of the inserted coin, means formed on said generally parallel surfaces to reduce the surface tension between said surfaces and a coin inserted in said chute, whereby the presence of water on said apparatus or on coins inserted in said chute during inclement weather has a reduced tendency to cause sticking of a coin within said chute, said generally parallel surfaces having means resiliently biasing them to a closed position in which the said surfaces are spaced apart a distance which slightly exceeds the thickness of a coin to be inserted into said chute, and said surfaces being movable away from each other to an opened position to release slugs or coins from said chute.

4. The apparatus of claim 3 wherein said means to reduce surface tension comprises a plurality of apertures formed in said generally parallel surfaces.

5. The apparatus of claim 3 wherein said chute and said parallel surfaces are inclined with respect to the vertical, whereby moisture stripped from a coin inserted into said chute may fall downwardly in a generally lateral direction away from said chute.

6. The apparatus of claim 3 including a central portion and longitudinal edge portions along either side of said central portion on at least one of said generally parallel surfaces; and said central portion being elevated with respect to said edge portions, whereby said central portion contacts a coin inserted into said chute.

7. The apparatus of claim 3 including at least one longitudinal slot formed in one of said generally parallel surfaces.

8. The apparatus of claim 3 including funnel means to initially receive a coin inserted into said chute, said funnel means including converging surfaces which lead to said generally parallel surfaces, and said funnel means serving to convey coins to the region of said chute which is bounded by said generally parallel surfaces.

9. The apparatus of claim 3 wherein said outdoor apparatus is a newspaper vending machine.

* * * * *